US008581888B2

(12) United States Patent
Lai et al.

(10) Patent No.: US 8,581,888 B2
(45) Date of Patent: Nov. 12, 2013

(54) LIQUID CRYSTAL DISPLAY AND LIQUID CRYSTAL DISPLAY PANEL THEREOF

(75) Inventors: Chun-Chi Lai, Taipei (TW); Ching-Wei Chen, Taichung (TW); Tsan-Chun Wang, Hsinchu (TW); Kuo-Hsing Cheng, Hsinchu County (TW); Yao-Jen Hsieh, Hsinchu County (TW)

(73) Assignee: Au Optronics Corporation, Hsinchu (TW)

( * ) Notice: Subject to any disclaimer, the term of this patent is extended or adjusted under 35 U.S.C. 154(b) by 231 days.

(21) Appl. No.: 13/097,095

(22) Filed: Apr. 29, 2011

(65) Prior Publication Data

US 2012/0169677 A1 Jul. 5, 2012

(30) Foreign Application Priority Data

Dec. 30, 2010 (TW) ..... 99146918 A

(51) Int. Cl.
*G09G 3/36* (2006.01)

(52) U.S. Cl.
USPC ..... 345/204

(58) Field of Classification Search
None
See application file for complete search history.

(56) References Cited

U.S. PATENT DOCUMENTS

| | | | | |
|---|---|---|---|---|
| 5,793,346 | A * | 8/1998 | Moon | 345/92 |
| 6,903,716 | B2 * | 6/2005 | Kawabe et al. | 345/99 |
| 8,193,999 | B2 * | 6/2012 | Takasaki | 345/1.1 |
| 8,299,992 | B2 * | 10/2012 | Chen et al. | 345/87 |
| 8,345,037 | B2 * | 1/2013 | Guan et al. | 345/213 |
| 2011/0012892 | A1 * | 1/2011 | Chen et al. | 345/214 |

* cited by examiner

*Primary Examiner* — Sumati Lefkowitz
*Assistant Examiner* — Joseph Fox
(74) *Attorney, Agent, or Firm* — Jianq Chyun IP Office

(57) ABSTRACT

A liquid crystal display (LCD) and an LCD panel thereof are provided. The structure of the pixel array of the LCD panel is the structure of the one third source driving (OTSD), and by which skillfully layout the coupled relationship among each pixel, each signal line and each scan line, such that the LCD panel can be driven by a column inversion to achieve the purpose of single-dot inversion displaying, and thus not only reducing the power consumption of the whole LCD, but also promoting the display quality.

20 Claims, 6 Drawing Sheets

LIQUID CRYSTAL DISPLAY AND LIQUID CRYSTAL DISPLAY PANEL THEREOF

CROSS-REFERENCE TO RELATED APPLICATION

This application claims the priority benefit of Taiwan application serial no. 99146918, filed on Dec. 30, 2010. The entirety of the above-mentioned patent application is hereby incorporated by reference herein and made a part of this specification.

BACKGROUND OF THE INVENTION

1. Field of the Invention

The present invention relates to a flat panel display, more particularly, to a liquid crystal display (LCD) and an LCD panel thereof.

2. Description of the Related Art

In the presence of all structures of the pixel array of the current LCD panel, one specie is so-called the half source driving (hereinafter "HSD") structure. The HSD structure would reduce the quantity used of source drivers to half by reducing the number of the source lines to half, such that the fabricating cost of the display panel module can be substantially reduced. In order to further reduce the fabricating cost, one kind of pixel array is submitted and which is so-called the one third source driving (hereinafter "OTSD") structure. The OTSD structure would reduce the number of the source lines to one third compared with the original/traditional pixel array structure, and thus the fabricating cost of the display panel module can be further reduced.

FIG. 1 is a diagram of the pixel array of the OTSD structure in the prior art, and FIG. 2 is a driving diagram of the pixel array in FIG. 1. Referring to FIGS. 1 and 2, it can be seen that, in FIGS. 1 and 2, the pixel array of the conventional OTSD structure would not change the number of the scan lines (Gn) in the display panel, but would reduce the number of the data lines (Sm) in the display panel to one third, such that the purpose of saving the fabricating cost can be achieved. However, since the images displayed by the LCD with the conventional OTSD structure is three-dot inversion, so the display quality is lower compared to the displayed images with single-dot inversion, and the pixel aperture ratio thereof is also lower, approximately 30%.

Accordingly, the conventional OTSD structure can be significantly improved.

SUMMARY OF THE INVENTION

The present invention is directed to an LCD and an LCD panel thereof, wherein the pixel array of the LCD panel is the OTSD structure and the LCD has better display quality and higher pixel aperture ratio compared to the LCD panel with the conventional OTSD structure as mentioned in the prior art.

The present invention provides an LCD including an LCD panel. The LCD panel includes a plurality of scan lines, a plurality of data lines, and) a plurality of pixels arranged in an array. The $i^{th}$ scan line is coupled to the $(6j+1)^{th}$ pixel of the $(i-2)^{th}$ pixel row, the $(6j+2)^{th}$, the $(6j+4)^{th}$, the $(6j+5)^{th}$ and the $(6j+6)^{th}$ pixels of the $i^{th}$ pixel row, and the $(6j+3)^{th}$ pixel of the $(i+2)^{th}$ pixel row, where i is an odd positive integer greater than or equal to 3, and j is a positive integer greater than or equal to 0. The $(i+1)^{th}$ scan line is coupled to the $(6j+6)^{th}$ pixel of the $(i-1)^{th}$ pixel row, the $(6j+1)^{th}$, the $(6j+2)^{th}$, the $(6j+3)^{th}$ and the $(6j+5)^{th}$ pixels of the $(i+1)^{th}$ pixel row, and the $(6j+4)^{th}$ pixel of the $(i+3)^{th}$ pixel row. The $r^{th}$ data line is coupled to even pixels in all pixels of the $(3k+1)^{th}$, the $(3k+3)^{th}$ and the $(3k+5)^{th}$ pixel columns, and odd pixels in all pixels of the $(3k+2)^{th}$, the $(3k+4)^{th}$ and the $(3k+6)^{th}$ pixel columns, where r is an odd positive integer, and the $k=(r-1)$. The $(r+1)^{th}$ data line is coupled to even pixels in all pixels of the $(3k+4)^{th}$, the $(3k+6)^{th}$ and the $(3k+8)^{th}$ pixel columns, and odd pixels in all pixels of the $(3k+5)^{th}$, the $(3k+7)^{th}$ and the $(3k+9)^{th}$ pixel columns.

In one embodiment of the present invention, the $1^{st}$ scan line is coupled to the $(6j+2)^{th}$, the $(6j+4)^{th}$, the $(6j+5)^{th}$ and the $(6j+6)^{th}$ pixels of the $1^{st}$ pixel row, and the $(6j+3)^{th}$ pixel of the $3^{rd}$ pixel row; and the $2^{nd}$ scan line is coupled to the $(6j+1)^{th}$, the $(6j+2)^{th}$, the $(6j+3)^{th}$ and the $(6j+5)^{th}$ pixels of the $2^{nd}$ pixel row, and the $(6j+4)^{th}$ pixel of the $4^{th}$ pixel row.

In one embodiment of the present invention, each of the $1^{st}$ to the $3^{rd}$ pixel columns in the LCD panel is a dummy pixel column; and each of the $1^{st}$ and the $2^{nd}$ pixel rows in the LCD panel is a dummy pixel row.

In one embodiment of the present invention, the LCD further includes a gate driver. The gate driver is coupled to the LCD panel and has a plurality of gate lines, wherein the gate driver provides a plurality of scan signals to the scan lines through the gate lines.

In one embodiment of the present invention, a frame period of the LCD has a plurality of periods. The $s^{th}$, the $(s+1)^{th}$ and the $(s+s\ 2)^{th}$ gate lines simultaneously output the enabled scan signals during the $(3s+1)^{th}$ period, where s is a positive integer greater than or equal to 0. The $s^{th}$ and the $(s+1)^{th}$ gate lines simultaneously output the enabled scan signals during the $(3s+2)^{th}$ period. The $s^{th}$ gate line outputs the enabled scan signal during the $(3s+3)^{th}$ period.

In one embodiment of the present invention, the LCD further includes a source driver. The source driver is coupled to the LCD panel and has a plurality of source lines, wherein the source driver provides a plurality of data signals to the data lines through the source lines.

In one embodiment of the present invention, a driving polarity corresponding to each of the data signals is converted once at a frame period of the LCD.

In one embodiment of the present invention, the LCD further includes a timing controller and a backlight module. The timing controller is coupled to the gate driver and the source driver, and used for controlling operations of the gate driver and the source driver. The backlight module is used for providing a backlight source required by the LCD panel.

The present invention would claim the whole structure of the above-mentioned LCD panel.

From the above, the structure of the pixel array of the LCD panel is the structure of the one third source driving (OTSD), namely, the number of the driving channels of the source driver can be reduced to two third. And, compared to the LCD with the conventional OTSD structure, the LCD panel of the present invention has higher pixel aperture ratio by skillfully layout the coupled relationship among each pixel, each signal line and each scan line. In addition, the source driver of the present invention can make the LCD panel to display images with single-dot inversion by adopting the column inversion driving manner, and thus promoting the display quality.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
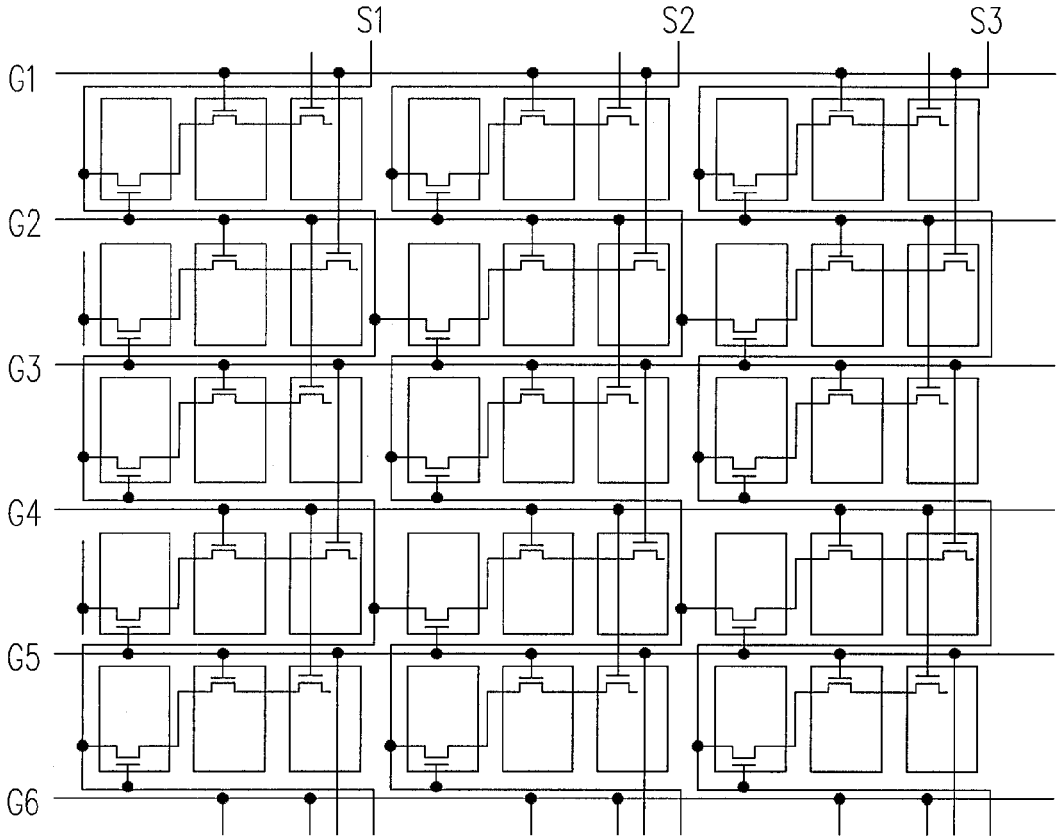
FIG. 1 (PRIOR ART)
FIG. 1 is a diagram of the pixel array of the OTSD structure in the prior art.
Figure 2:
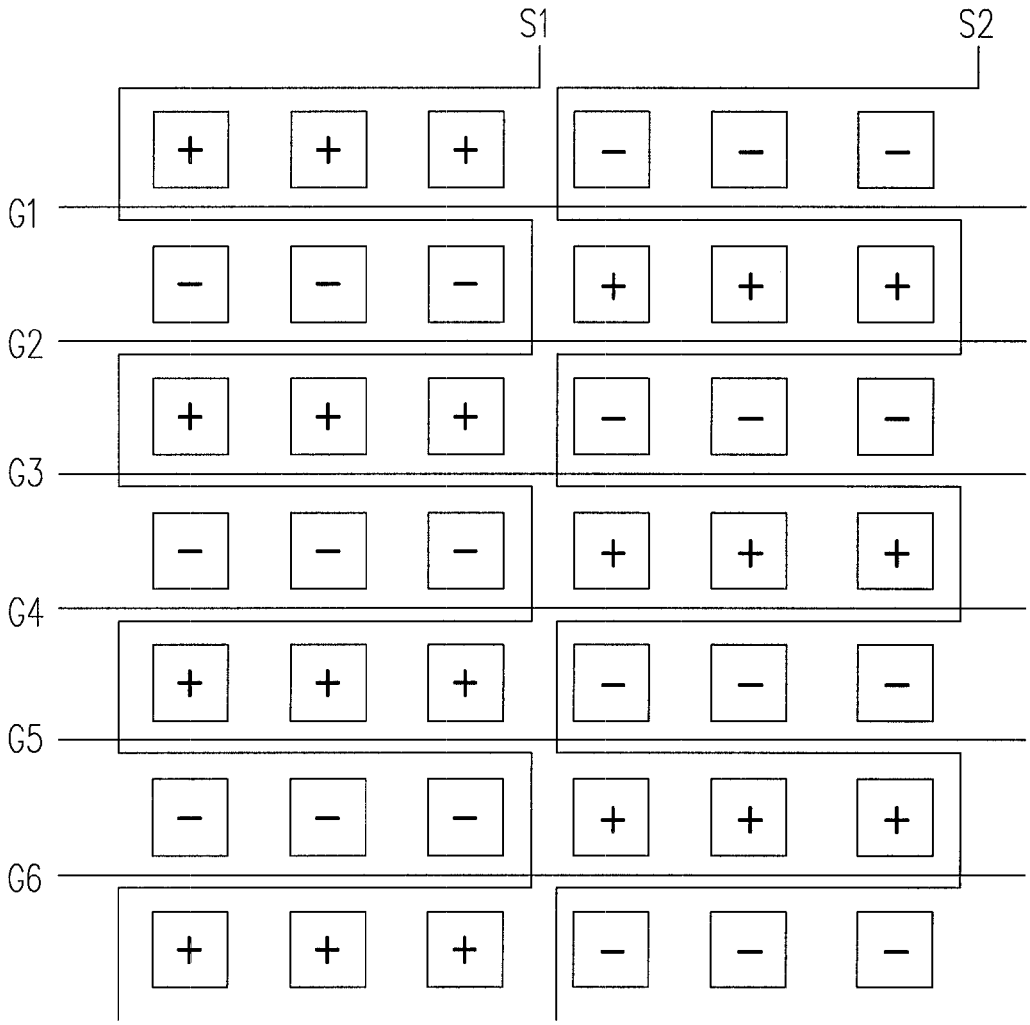
FIG. 2 (PRIOR ART)
FIG. 2 is a driving diagram of the pixel array in FIG. 1.

Reference will now be made in detail to the present preferred embodiments of the invention, examples of which are illustrated in the accompanying drawings. Wherever possible, the same reference numbers are used in the drawings and the description to refer to the same or like parts.

Figure 3:
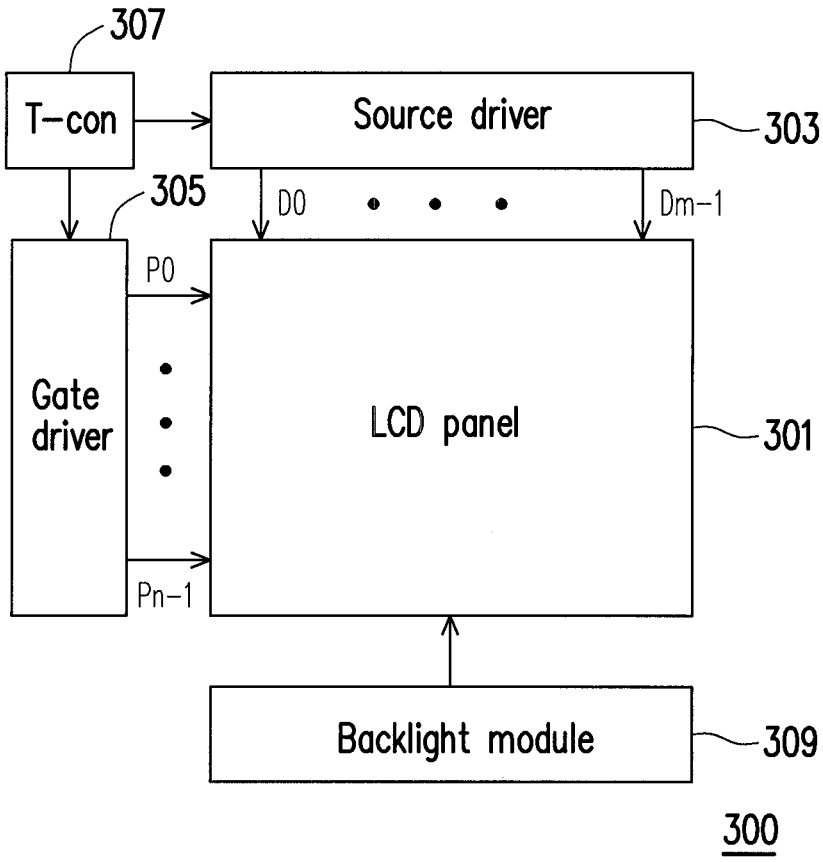
FIG. 3 is a system diagram of the LCD 300 according to one embodiment of the present invention.
Figure 4:
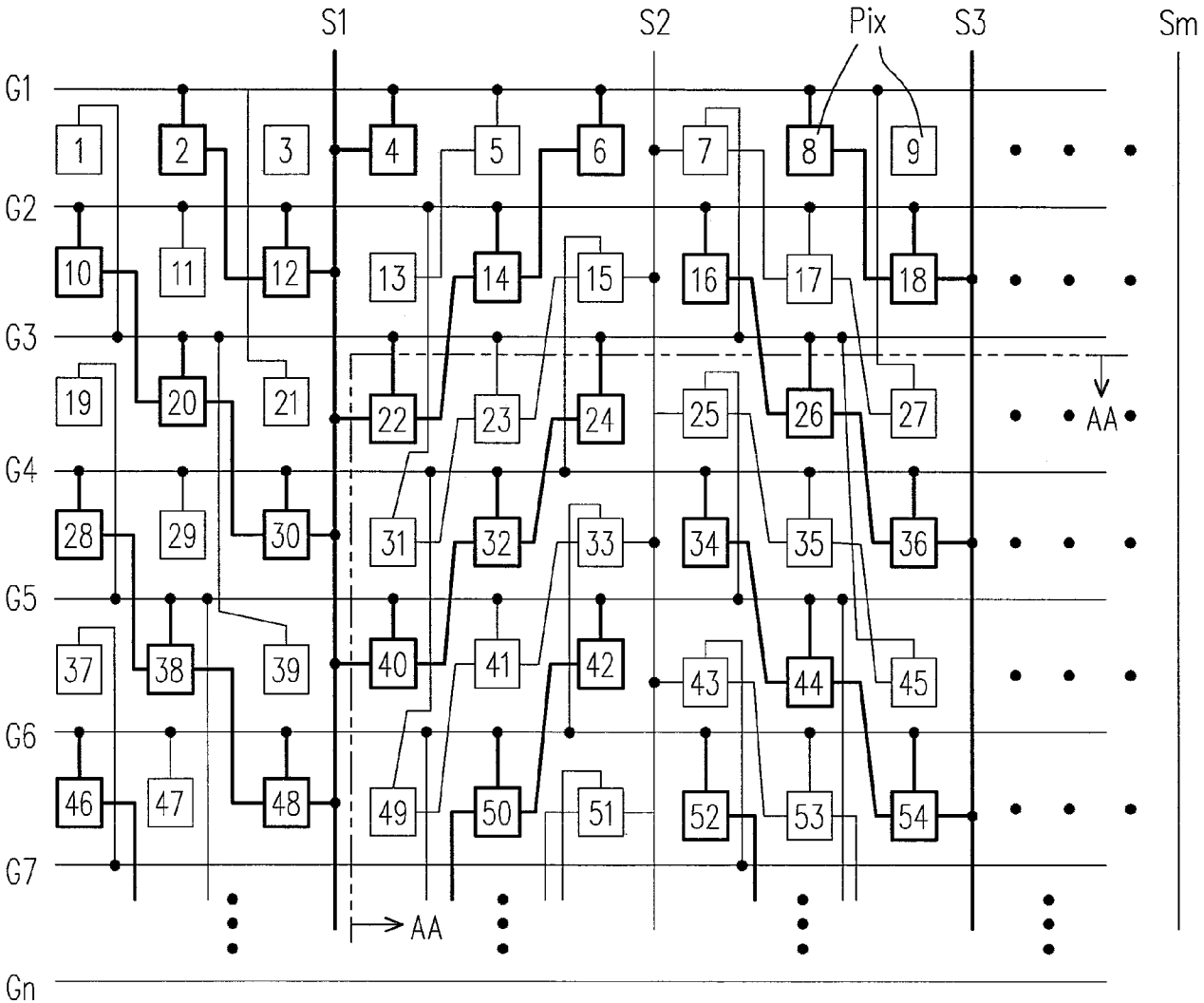
FIG. 4 is a diagram of the LCD panel 301 in FIG. 3.

FIG. 3 is a system diagram of the LCD 300 according to one embodiment of the present invention, and FIG. 4 is a diagram of the LCD panel 301 in FIG. 3. Referring to FIGS. 3 and 4, the LCD 300 includes the LCD panel 301, a source driver 303, a gate driver 305, a timing controller (T-con) 307 and a backlight module 309.

In the present embodiment, the LCD panel 301 includes a plurality of data lines S1 to Sm, a plurality of scan lines G1 to Gn, and a plurality of pixels Pix arranged in an array. Each of the pixels Pix in the $1^{st}$ and the $2^{nd}$ pixel rows and the $1^{st}$ to the $3^{rd}$ pixel columns is a dummy pixel, and is not disposed within the display area AA of the LCD panel 301. In other words, each of the $1^{st}$ to the $3^{rd}$ pixel columns in the LCD panel 301 is a dummy pixel column; and each of the $1^{st}$ and the $2^{nd}$ pixel rows in the LCD panel 301 is a dummy pixel row.

The source driver 303 is coupled to the LCD panel 301, and has a plurality of source lines D0 to Dm−1, wherein the source lines D0 to Dm−1 can be understood as the driving channels of the source driver 301. The source driver 303 provides a plurality of data signals to the data lines S1 to Sm through the source lines D0 to Dm−1, so as to perform the pixel writing to the corresponding pixels Pix in the LCD panel 301. Herein, the source lines D0 to Dm−1 are respectively corresponding to the data lines 51 to Sm.

The gate driver 305 is coupled to the LCD panel 301, and has a plurality of gate lines P0 to Pn−1. The gate driver 305 provides a plurality of scan signals to the scan lines G1 to Gn through the gate lines P0 to Pn−1, so as to perform the pixel on or off to the corresponding pixels Pix in the LCD panel 301. The gate lines P0 to Pn−1 are respectively corresponding to the scan lines G1 to Gn. In addition, the T-con 307 is coupled to the source driver 303 and the gate driver 305, and used for controlling the operations of the source driver 303 and the gate driver 305. The backlight module 309 is used for providing the backlight source required by the LCD panel 301.

In the present embodiment, relating to the scan lines G1 to Gn of the LCD panel 301, the $1^{st}$ scan line G1 is coupled to the $(6j+2)^{th}$, the $(6j+4)^{th}$, the $(6j+5)^{th}$ and the $(6j+6)^{th}$ pixels of the $1^{st}$ pixel row, and the $(6j+3)^{th}$ pixel of the $3^{rd}$ pixel row in the LCD panel 301, where j is a positive integer greater than or equal to 0. For example, if j=0, the $1^{st}$ scan line G1 is coupled to the $2^{nd}$, the $4^{th}$, the $5^{th}$ and the $6^{th}$ to pixels of the $1^{st}$ pixel row and the $3^{rd}$ pixel of the $3^{rd}$ pixel row. Moreover, if j=1, the $1^{st}$ scan line G1 is coupled to the $8^{th}$, the $10^{th}$, the $11^{th}$ and the $12^{th}$ pixels of the $1^{st}$ pixel row and the $9^{th}$ pixel of the $3^{rd}$ pixel row, and so on.

In addition, the $2^{nd}$ scan line G2 is coupled to the $(6j+1)^{th}$, the $(6j+2)^{th}$, the $(6j+3)^{th}$ and the $(6j+5)^{th}$ pixels of the $2^{nd}$ pixel row, and the $(6j+4)^{th}$ pixel of the $4^{th}$ pixel row in the LCD panel 301. For example, if j=0, the $2^{nd}$ scan line G2 is coupled to the $1^{st}$, the $2^{nd}$, the $3^{rd}$ and the $5^{th}$ pixels of the $2^{nd}$ pixel row, and the $4^{th}$ pixel of the $4^{th}$ pixel row. Moreover, if j=1, the $2^{nd}$ scan line G2 is coupled to the $7^{th}$, the $8^{th}$, the $9^{th}$ and the $11^{th}$ pixels of the $2^{nd}$ pixel row, and the $10^{th}$ pixel of the $4^{th}$ pixel row, and so on.

Except the $1^{st}$ and the $2^{nd}$ scan lines G1 and G2, the $i^{th}$ scan line is coupled to the $(6j+1)^{th}$ pixel of the $(i-2)^{th}$ pixel row, the $(6j+2)^{th}$, the $(6j+4)^{th}$, the $(6j+5)^{th}$ and the $(6j+6)^{th}$ pixels of the $i^{th}$ pixel row, and the $(6j+3)^{th}$ pixel of the $(i+2)^{th}$ pixel row, where i is an odd positive integer greater than or equal to 3. For example, if i=3 and j=0, the $3^{rd}$ scan line G3 is coupled to the $1^{st}$ pixel of the $1^{st}$ pixel row, the $2^{nd}$, the $4^{th}$, the $5^{th}$ and the $6^{th}$ pixels of the $3^{rd}$ pixel row, and the $3^{rd}$ pixel of the $5^{th}$ pixel row. Moreover, if i=3 and j=1, the $3^{rd}$ scan line G3 is coupled to the $7^{th}$ pixel of the $1^{st}$ pixel row, the $8^{th}$, the $10^{th}$, the $11^{th}$ and the $12^{th}$ pixels of the $3^{rd}$ pixel row, and the $9^{th}$ pixel of the $5^{th}$ pixel row, and so on.

Further for example, if i=5 and j=0, the $5^{th}$ scan line G5 is coupled to the $1^{st}$ pixel of the $3^{rd}$ pixel row, the $2^{nd}$, the $4^{th}$, the $5^{th}$ and the $6^{th}$ pixels of the $5^{th}$ pixel row, and the $3^{rd}$ pixel of the $7^{th}$ pixel row. Moreover, if i=5 and j=1, the $5^{th}$ scan line G5 is coupled to the $7^{th}$ pixel of the $3^{rd}$ pixel row, the $8^{th}$, the $10^{th}$, the $11^{th}$ and the $12^{th}$ pixels of the $5^{th}$ pixel row, and the $9^{th}$ pixel of the $7^{th}$ pixel row, and so on.

And, the $(i+1)^{th}$ scan line is coupled to the $(6j+6)^{th}$ pixel of the $(i-1)^{th}$ pixel row, the $(6j+1)^{th}$, the $(6j+2)^{th}$, the $(6j+3)^{th}$ and the $(6j+5)^{th}$ pixels of the $(i+1)^{th}$ pixel row, and the $(6j+4)^{th}$ pixel of the $(i+3)^{th}$ pixel row. For example, if i=3 and j=0, the $4^{th}$ scan line G4 is coupled to the $6^{th}$ pixel of the $2^{nd}$ pixel row, the $1^{st}$, the $2^{nd}$, the $3^{rd}$ and the $5^{th}$ pixels of the $4^{th}$ pixel row, and the $4^{th}$ pixel of the $6^{th}$ pixel row. Moreover, if i=3 and j=1, the $4^{th}$ scan line G4 is coupled to the $12^{th}$ pixel of the $2^{nd}$ pixel row, the $7^{th}$, the $8^{th}$, the $9^{th}$ and the $11^{th}$ pixels of the $4^{th}$ pixel row, and the $10^{th}$ pixel of the $6^{th}$ pixel row, and so on.

Relating to the data lines S1 to Sm in the LCD panel 301, the $r^{th}$ data line is coupled to even pixels in all pixels of the $(3k+1)^{th}$, the $(3k+3)^{th}$ and the $(3k+5)^{th}$ pixel columns, and odd pixels in all pixels of the $(3k+2)^{th}$, the $(3k+4)^{th}$ and the $(3k+6)^{th}$ pixel columns, where r is an odd positive integer, and the k=(r−1). For example, if r=1, the $1^{st}$ data line S1 is coupled to even pixels in all pixels of the $1^{st}$, the $3^{rd}$ and the $5^{th}$ pixel columns, and odd pixels in all pixels of the $2^{nd}$, the $4^{th}$ and the $6^{th}$ pixel columns. Moreover, r=3, the $3^{rd}$ data line S3 is coupled to even pixels in all pixels of the $7^{th}$, the $9^{th}$ and the $11^{th}$ pixel columns, and odd pixels in all pixels of the $8^{th}$, the $10^{th}$ and the $12^{th}$ pixel columns, and so on.

In addition, the $(r+1)^{th}$ data line is coupled to even pixels in all pixels of the $(3k+4)^{th}$, the $(3k+6)^{th}$ and the $(3k+8)^{th}$ pixel columns, and odd pixels in all pixels of the $(3k+5)^{th}$, the $(3k+7)^{th}$ and the $(3k+9)^{th}$ pixel columns. For example, if r=1, the $2^{nd}$ data line S2 is coupled to even pixels in all pixels of the $4^{th}$, the $6^{th}$ and the $8^{th}$ pixel columns, and odd pixels in all pixels of the $5^{th}$, the $7^{th}$ and the $9^{th}$ pixel columns. Moreover, if r=3, the $4^{th}$ data line S4 is coupled to even pixels in all pixels of the $10^{th}$, the $12^{th}$ and the $14^{th}$ pixel columns, and odd pixels in all pixels of the $11^{th}$, the $13^{th}$ and the $15^{th}$ pixel columns, and so on.

Figure 5:
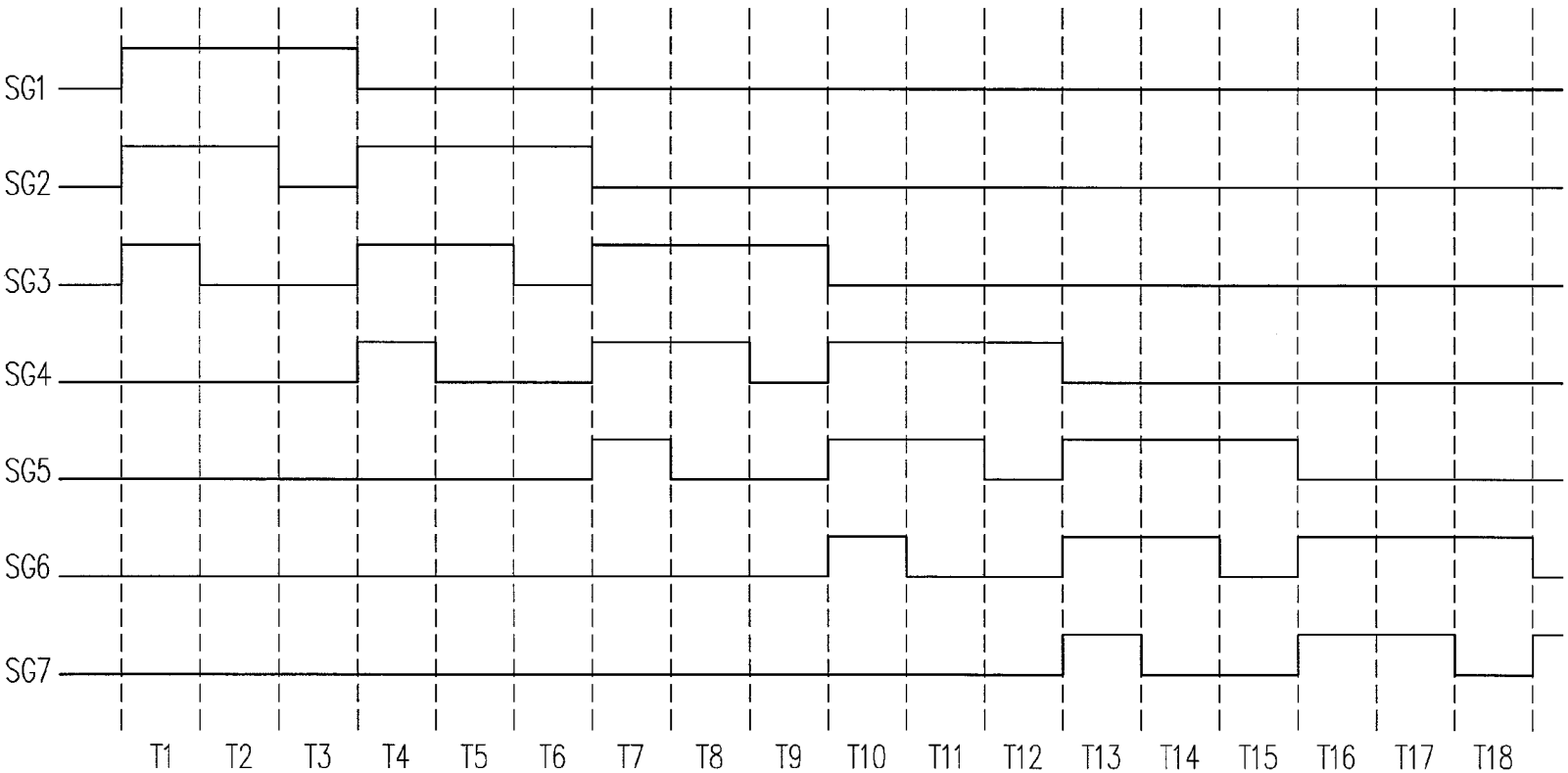
FIG. 5 is a diagram of a part of driving waveforms for the LCD panel 301 according to one embodiment of the present invention.

From the above, FIG. 5 is a diagram of a part of driving waveforms for the LCD panel 301 according to one embodiment of the present invention. Referring to FIGS. 3 and 5, it can be clearly seen that, in FIG. 5, one frame period of the LCD 300 has a plurality of periods, for example, T1 to T18, but not limited thereto. In the present embodiment, the $s^{th}$, the $(s+1)^{th}$ and the $(s+2)^{th}$ gate lines simultaneously output the enabled scan signals during the $(3s+1)^{th}$ period, where s is a positive integer greater than or equal to 0. In addition, The $s^{th}$ and the $(s+1)^{th}$ gate lines simultaneously output the enabled scan signals during the $(3s+2)^{th}$ period. Furthermore, the $s^{th}$ gate line outputs the enables scan signal during the $(3s+3)^{th}$ period.

For example, if s=0, the $0^{th}$ to the $2^{nd}$ gate lines P0 to P2 of the gate driver 305 simultaneously output the enabled scan signals SG1 to SG3 to the scan lines G1 to G3 during the $1^{st}$ period T1; the $0^{th}$ and the $1^{st}$ gate lines P0 and P1 of the gate driver 305 simultaneously output the enabled scan signals SG1 and SG2 to the scan lines G1 and G2 during the $2^{nd}$ period T2; and the $0^{th}$ gate line P0 of the gate driver 305 outputs the enabled scan signal SG1 to the scan line G1 during the $3^{rd}$ period T3.

Moreover, if s=1, the $1^{st}$ to the $3^{rd}$ gate lines P1 to P3 of the gate driver 305 simultaneously output the enabled scan signals SG2 to SG4 to the scan lines G2 to G4 during the $4^{th}$ period T4; the $1^{st}$ and the $2^{nd}$ gate lines P1 and P2 of the gate driver 305 simultaneously output the enabled scan signals SG2 and SG3 to the scan lines G2 and G3 during the $5^{th}$ period T5; and the $1^{st}$ gate line P1 of the gate driver 305 outputs the enabled scan signal SG2 to the scan line G2 during the $6^{th}$ period T6, and so on.

Below, fifty-four serial numbers of pixels Pix in FIG. 4, and both the source driver 303 and the gate driver 305 in FIG. 5 would be taken as an example for explaining how does the source driver 303 and the gate driver 305 to drive each of the pixels Pix in the LCD panel 301.

Firstly, during the $1^{st}$ period T1, the $0^{th}$ to the $2^{nd}$ gate lines P0 to P2 of the gate driver 305 would simultaneously output the enabled scan signals SG1 to SG3 to the scan lines G1 to G3, so as to turn on the pixels with marked number of 2, 4, 5, 6, 8, 21, 27, 10, 11, 12, 14, 16, 17, 18, 31, 1, 7, 20, 22, 23, 24, 26, 39 and 45. Meanwhile, the source driver 303 would write the corresponding data signals into the Pixels Pix connected to the data lines S1 to Sm and turned on during the period T1 through the source lines D0 to Dm−1.

Next, during the $2^{nd}$ period T2, the $0^{th}$ and the $1^{st}$ gate lines P0 ad P1 of the gate driver 305 would simultaneously output the enabled scan signals SG1 and SG2 to the scan lines G1 and G2, so as to turn on the pixels with marked number of 2, 4, 5, 6, 8, 21, 27, 10, 11, 12, 14, 16, 17, 18 and 31. Meanwhile, the source driver 303 would write the corresponding data signals into the Pixels Pix connected to the data lines S1 to Sm and turned on during the period T2 through the source lines D0 to Dm−1.

Next, during the $3^{rd}$ period T3, the $0^{th}$ gate line P0 of the gate driver 305 would output the enabled scan signals SG1 to the scan line G1, so as to turn on the pixels with marked number of 2, 4, 5, 6, 8, 21 and 27. Meanwhile, the source driver 303 would write the corresponding data signals into the Pixels Pix connected to the data lines S1 to Sm and turned on during the period T3 through the source lines D0 to Dm−1.

Figure 6:
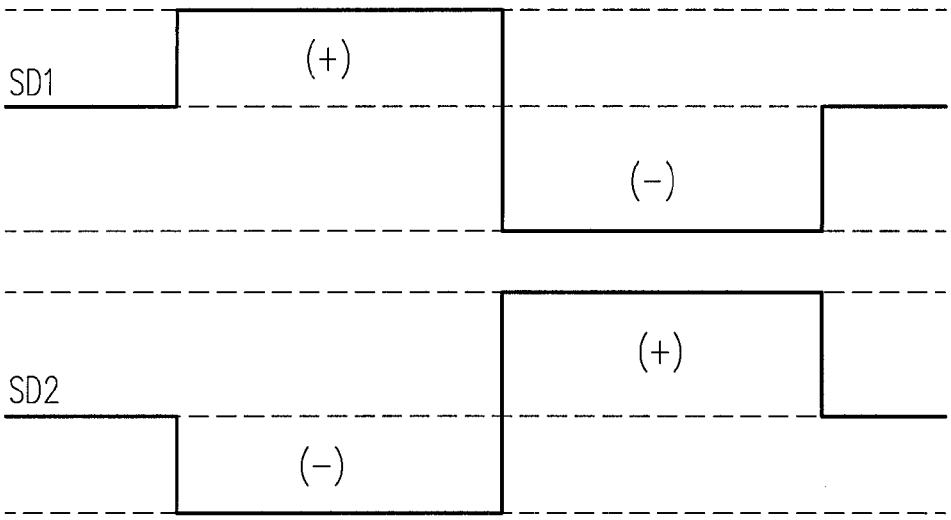
FIG. 6 is a waveform diagram of the data signal according to one embodiment of the present invention.

Moreover, the source driver 303 would provide the corresponding data signals through the source lines D0 to Dm−1 during the following periods T4 to T18 until all of the pixels Pix in the LCD panel 301 are written completely, and thus making the LCD 300 display the images to user. Moreover, in the present embodiment, the driving polarity corresponding to each of the data signals provided by the source driver 303 is converted once at one frame period of the LCD 300. For example, the data signals SD1 and SD2 respectively provided to the source lines D0 and D1 by the source driver 303 can be shown as FIG. 6. During the previous frame period, the driving polarities of the data signals SD1 and SD2 are respectively positive (+) and negative (−); and during the next frame period, the driving polarities of the data signals SD1 and SD2 are respectively converted to negative (−) and positive (+). In other words, the source driver 303 would drive the LCD panel 301 by using the column inversion driving manner so as to achieve the purpose of displaying effect with single-dot inversion.

In summary, in the present invention, the specific coupled relationship among each pixel, each signal line and each scan line, and the corresponding driving waveforms for the gate driver are used to achieve the structure of OTSD. Accordingly, not only the fabricating cost can be reduced, but also the LCD panel of the present invention can have higher pixel aperture ratio, approximately 50% compared to the LCD panel with the conventional OTSD structure as mentioned in the prior art. In addition, the source driver of the present invention can make the LCD panel to display images with single-dot inversion by adopting the column inversion driving manner, and thus promoting the display quality.

It will be apparent to those skills in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A liquid crystal display (LCD), comprising:

an LCD panel, comprising:

a plurality of scan lines;

a plurality of data lines; and a plurality of pixels arranged in an array;

wherein the $i^{th}$ scan line is coupled to the $(6j+1)^{th}$ pixel of the $(i-2)^{th}$ pixel row, the $(6j+2)^{th}$, the $(6j+4)^{th}$, the $(6j+5)^{th}$ and the $(6j+6)^{th}$ pixels of the $i^{th}$ pixel row, and the $i^{th}$ scan line is configured to provide a first scan signal to the $(6j+1)^{th}$ pixel of the $(i-2)^{th}$ pixel row, the $(6j+2)^{th}$, the $(6j+4)^{th}$, the $(6j+5)^{th}$, and the $(6j+6)^{th}$ pixels of the pixel row, and the $(6j+3)^{th}$ pixel of the $(i+2)^{th}$ pixel row, where i is an odd positive integer greater than or equal to 3, and j is a positive integer greater than or equal to 0;

the $(i+1)^{th}$ scan line is coupled to the $(6j+6)^{th}$ pixel of the $(i-1)$ pixel row, the $(6j+1)^{th}$, the $(6j+2)^{th}$, the $(6j+3)^{th}$ and the $(6j+5)^{th}$ pixels of the $(i+1)^{th}$ pixel row, and the $(6j+4)^{th}$ pixel of the $(i+3)^{th}$ pixel row, and the $(i+1)^{th}$ scan line is configured to provide a second scan signal to the $(6j+6)^{th}$ pixel of the $(i-1)^{th}$ pixel row, the $(6j+1)^{th}$, the $(6j+2)^{th}$, the $(6j+3)^{th}$ and the $(6j+5)^{th}$ pixels of the $(i+1)^{th}$ pixel row, and the $(6j+4)^{th}$ pixel of the $(i+3)^{th}$ pixel row;

the $r^{th}$ data line is coupled to even pixels in all pixels of the $(3k+1)^{th}$, the $(3k+3)^{th}$ and the $(3k+5)^{th}$ pixel columns, and odd pixels in all pixels of the $(3k+2)^{th}$, the $(3k+4)^{th}$ and the $(3k+6)^{th}$ pixel columns, where r is an odd positive integer, and the k=(r−1); and the $(r+1)^{th}$ data line is coupled to even pixels in all pixels of the $(3k+4)^{th}$, the $(3k+6)^{th}$ and the $(3k+8)^{th}$ pixel columns, and odd pixels in all pixels of the $(3k+5)^{th}$, the $(3k+7)^{th}$ and the $(3k+9)^{th}$ pixel columns.

2. The LCD according to claim 1, wherein the $1^{st}$ scan line is coupled to the $(6j+2)^{th}$, the $(6j+4)^{th}$, the $(6j+5)^{th}$ and the $(6j+6)^{th}$ pixels of the $1^{st}$ pixel row, and the $(6j+3)^{th}$ pixel of the $3^{rd}$ pixel row; and the $2^{nd}$ scan line is coupled to the $(6j+1)^{th}$, the $(6j+2)^{th}$, the $(6j+3)^{th}$ and the $(6j+5)^{th}$ pixels of the $2^{nd}$ pixel row, and the $(6j+4)^{th}$ pixel of the $4^{th}$ pixel row.

3. The LCD according to claim 2, wherein each of the $1^{st}$ to the $3^{rd}$ pixel columns in the LCD panel is a dummy pixel column; and each of the $1^{st}$ and the $2^{nd}$ pixel rows in the LCD panel is a dummy pixel row.

4. The LCD according to claim 1, further comprising:

a gate driver, coupled to the LCD panel and having a plurality of gate lines, wherein the gate driver provides a plurality of scan signals to the scan lines through the gate lines.

5. The LCD according to claim 4, wherein a frame period of the LCD has a plurality of periods, and the $s^{th}$, the $(s+1)^{th}$ and the $(s+2)^{th}$ gate lines simultaneously output the enabled scan signals during the $(3s+1)^{th}$ period, where s is a positive integer greater than or equal to 0.

6. The LCD according to claim 5, wherein the $s^{th}$ and the $(s+1)^{th}$ gate lines simultaneously output the enabled scan signals during the $(3s+2)^{th}$ period.

7. The LCD according to claim 6, wherein the $s^{th}$ gate line outputs the enabled scan signal during the $(3s+3)^{th}$ period.

8. The LCD according to claim 4, further comprising:

a source driver, coupled to the LCD panel and having a plurality of source lines, wherein the source driver provides a plurality of data signals to the data lines through the source lines.

9. The LCD according to claim 8, wherein a driving polarity corresponding to each of the data signals is converted once at a frame period of the LCD.

10. The LCD according to claim 8, further comprising:

a timing controller, coupled to the gate driver and the source driver, and for controlling operations of the gate driver and the source driver; and a backlight module, for providing a backlight source required by the LCD panel.

11. The LCD according to claim 1, wherein the $r^{th}$ data line is configured to provide a first data signal to the even pixels in all pixels of the $(3k+1)^{th}$, the $(3k+3)^{th}$ and the $(3k+5)^{th}$ pixel columns, and to the odd pixels in all pixels of the $(3k+2)^{th}$, the $(3k+4)^{th}$ and the $(3k+6)^{th}$ pixel columns, and the $(r+1)^{th}$ data line is configured to provide a second data signal to the even pixels in all pixels of the $(3k+4)^{th}$, the $(3k+6)^{th}$ and the $(3k+8)^{th}$ pixel columns, and to the odd pixels in all pixels of the $(3k+5)^{th}$, the $(3k+7)^{th}$ and the $(3k+9)^{th}$ pixel columns.

12. The LCD according to claim 11, further comprising:

a gate driver, coupled to the LCD panel and having a plurality of gate lines, wherein the gate driver provides a plurality of scan signals to the scan lines through the gate lines wherein a frame period of the LCD has a plurality of periods, and the $s^{th}$, the $(s+1)^{th}$ and the (s+2) gate lines simultaneously output the enabled scan signals during the $(3s+1)^{th}$ period, where s is a positive integer greater than or equal to 0.

13. The LCD according to claim 12, wherein the $s^{th}$ and the $(s+1)^{th}$ gate lines simultaneously output the enabled scan signals during the $(3s+2)^{th}$ period; and the $s^{th}$ gate line outputs the enabled scan signal during the $(3s+3)^{th}$ period.

14. The LCD according to claim 12, further comprising:

a source driver, coupled to the LCD panel and having a plurality of source lines, wherein the source driver provides a plurality of data signals to the data lines through the source lines, wherein a driving polarity corresponding to each of the data signals is converted once at a frame period of the LCD.

15. A liquid crystal display (LCD) panel, comprising:

a plurality of scan lines;

a plurality of data lines; and a plurality of pixels arranged in an array;

wherein the $i^{th}$ scan line is coupled to the $(6j+1)^{th}$ pixel of the $(i-2)^{th}$ pixel row, the $(6j+2)^{th}$, the $(6j+4)^{th}$, the $(6j+5)^{th}$ and the $(6j+6)^{th}$ pixels of the $i^{th}$ pixel row, and the $(6j+3)^{th}$ pixel of the $(i+2)^{th}$ pixel row, and the $i^{th}$ scan line is configured to provide a first scan signal to the $(6j+1)^{th}$ pixel of the $(i-2)^{th}$ pixel row, the $(6j+2)^{th}$, the $(6j+4)^{th}$, the $(6j+5)^{th}$, and the $(6j+6)^{th}$ pixels of the $i^{th}$ pixel row, and the $(6j+3)^{th}$ pixel of the $(i+2)^{th}$ pixel row, where i is an odd positive integer greater than or equal to 3, and j is a positive integer greater than or equal to 0;

the $(i+1)^{th}$ scan line is coupled to the $(6j+6)^{th}$ pixel of the $(i-1)^{th}$ pixel row, the $(6j+1)^{th}$, the $(6j+2)^{th}$, the $(6j+3)^{th}$ and the $(6j+5)^{th}$ pixels of the $(i+1)^{th}$ pixel row, and the $(6j+4)^{th}$ pixel of the $(i+3)^{th}$ pixel row, and the $(i+1)^{th}$ scan line is configured to provide a second scan signal to the $(6j+6)^{th}$ pixel of the $(i-1)^{th}$ pixel row, the $(6j+1)^{th}$, the $(6j+2)^{th}$, the $(6j+3)^{th}$ and the $(6j+5)^{th}$ pixels of the $(i+1)^{th}$ pixel row, and the $(6j+4)^{th}$ pixel of the $(i+3)^{th}$ pixel row;

the $r^{th}$ data line is coupled to even pixels in all pixels of the $(3k+1)^{th}$, the $(3k+3)^{th}$ and the $(3k+5)^{th}$ pixel columns, and odd pixels in all pixels of the $(3k+2)^{th}$, the $(3k+4)^{th}$ and the $(3k+6)^{th}$ pixel columns, where r is an odd positive integer, and the k=(r−1); and the $(r+1)^{th}$ data line is coupled to even pixels in all pixels of the $(3k+4)^{th}$, the $(3k+6)^{th}$ and the $(3k+8)^{th}$ pixel columns, and odd pixels in all pixels of the $(3k+5)^{th}$, the $(3k+7)^{th}$ and the $(3k+9)^{th}$ pixel columns.

16. The LCD panel according to claim 15, wherein the $1^{st}$ scan line is coupled to the $(6j+2)^{th}$, the $(6j+4)^{th}$, the $(6j+5)^{th}$ and the $(6j+6)^{th}$ pixels of the $1^{st}$ pixel row, and the $(6j+3)^{th}$ pixel of the $3^{rd}$ pixel row; and the $2^{nd}$ scan line is coupled to the $(6j+1)^{th}$, the $(6j+2)^{th}$, the $(6j+3)^{th}$ and the $(6j+5)^{th}$ pixels of the $2^{nd}$ pixel row, and the $(6j+4)^{th}$ pixel of the $4^{th}$ pixel row.

17. The LCD panel according to claim 16, wherein each of the $1^{st}$ to the $3^{rd}$ pixel columns in the LCD panel is a dummy pixel column; and each of the $1^{st}$ and the $2^{nd}$ pixel rows in the LCD panel is a dummy pixel row.

18. The LCD panel according to claim 15, wherein the $r^{th}$ data line is configured to provide a first data signal to the even pixels in all pixels of the $(3k+1)^{th}$, the $(3k+3)^{th}$ and the $(3k+5)^{th}$ pixel columns, and to odd pixels in all pixels of the $(3k+2)^{th}$, the $(3k+4)^{th}$ and the $(3k+6)^{th}$ pixel columns, and the $(r+1)^{th}$ data line is configured to provide a second data signal to the even pixels in all pixels of the $(3k+4)^{th}$, the $(3k+6)^{th}$ and the $(3k+8)^{th}$ pixel columns, and to the odd pixels in all pixels of the $(3k+5)^{th}$, the $(3k+7)^{th}$ and the $(3k+9)^{th}$ pixel columns.

19. The LCD panel according to claim 18, wherein the $1^{st}$ scan line is coupled to the $(6j+2)^{th}$, the $(6j+4)^{th}$, the $(6j+5)^{th}$ and the $(6j+6)^{th}$ pixels of the $1^{st}$ pixel row, and the $(6j+3)^{th}$ pixel of the $3^{rd}$ pixel row; and the $2^{nd}$ scan line is coupled to the $(6j+1)^{th}$, the $(6j+2)^{th}$, the $(6j+3)^{th}$ and the $(6j+5)^{th}$ pixels of the $2^{nd}$ pixel row, and the $(6j+4)^{th}$ pixel of the $4^{th}$ pixel row.

20. The LCD panel according to claim 19, wherein each of the $1^{st}$ to the $3^{rd}$ pixel columns in the LCD panel is a dummy pixel column; and each of the $1^{st}$ and the $2^{nd}$ pixel rows in the LCD panel is a dummy pixel row.

* * * * *